US007500507B2

(12) United States Patent
Makino et al.

(10) Patent No.: US 7,500,507 B2
(45) Date of Patent: Mar. 10, 2009

(54) METHOD AND DEVICE FOR POURING MOLTEN METAL IN VACUUM MOLDING AND CASTING

(75) Inventors: Hiroyasu Makino, Toyokawa (JP); Taketoshi Tomita, Toyokawa (JP); Takafumi Oba, Toyokawa (JP); Hiroaki Suzuki, Toyokawa (JP); Kenji Mizuno, Toyokawa (JP); Toshiaki Ando, Toyokawa (JP); Yoshinobu Enomoto, Toyokawa (JP); Takao Inoue, Toyokawa (JP); Shizuo Takeda, Toyokawa (JP)

(73) Assignee: Sintokogio, Ltd., Aichi (JP)

( * ) Notice: Subject to any disclaimer, the term of this patent is extended or adjusted under 35 U.S.C. 154(b) by 38 days.

(21) Appl. No.: 11/547,541

(22) PCT Filed: Apr. 1, 2005

(86) PCT No.: PCT/JP2005/006481

§ 371 (c)(1),
(2), (4) Date: Oct. 2, 2006

(87) PCT Pub. No.: WO2005/095022

PCT Pub. Date: Oct. 13, 2005

(65) Prior Publication Data

US 2007/0209771 A1 Sep. 13, 2007

(30) Foreign Application Priority Data

Apr. 1, 2004 (JP) ..... 2004-108911
Apr. 28, 2004 (JP) ..... 2004-132681
Feb. 4, 2005 (JP) ..... 2005-028325

(51) Int. Cl.
*B22C 9/03* (2006.01)

(52) U.S. Cl. ..... 164/7.2; 164/160.2

(58) Field of Classification Search ..... 164/7.2, 164/119, 160.2, 306–308, 348
See application file for complete search history.

(56) References Cited

U.S. PATENT DOCUMENTS 4,076,070 A 2/1978 Lefebvre et al.

(Continued)

FOREIGN PATENT DOCUMENTS

DE 33 05 839 A1 8/1984

(Continued)

*Primary Examiner*—Kuang Lin
(74) *Attorney, Agent, or Firm*—Finnegan, Henderson, Farabow, Garrett & Dunner, L.L.P.

(57) ABSTRACT

A pouring method and a device in a vacuum sealed process to produce a thin-wall cast by using a mold framing for the a vacuum sealed process, and a as-cast product using the pouring method are provided. The pouring method comprises the steps of: sealingly covering the surface of a pattern plate by a shielding member; placing a mold framing on the shielding member and then putting a fill that does not include any binder in the mold framing; sealingly covering an upper surface of the fill and then evacuating an inside of the mold framing to suck the shielding member to the fill to shape the shielding member; removing the pattern plate from the shielding member, thereby forming a mold half that has a molding surface; forming another mold half in a similar way and mating the mold halves to define a molding cavity; pouring molten metal in the molding cavity; and releasing the negative pressure in the mold framing to take out a as-cast product, and further comprises the step of decompressing the molding cavity before pouring molten metal in the mated mold.

2 Claims, 11 Drawing Sheets

U.S. PATENT DOCUMENTS

| | | | | | |
|---|---|---|---|---|---|
| 4,100,958 | A | * | 7/1978 | Workman | 164/7.2 |
| 4,129,164 | A | | 12/1978 | Torikai | |
| 4,318,437 | A | * | 3/1982 | Kemp | 164/7.2 |
| 4,804,032 | A | * | 2/1989 | Wilkins | 164/34 |
| 5,329,981 | A | * | 7/1994 | Ito et al. | 164/7.2 |

FOREIGN PATENT DOCUMENTS

| | | | | |
|---|---|---|---|---|
| GB | 1 028 736 | A | | 5/1966 |
| JP | 54-118216 | | | 9/1979 |
| JP | 56-169964 | U | | 12/1981 |
| JP | 57106463 | A | * | 7/1982 |
| JP | 1-180769 | A | | 7/1989 |
| JP | 7-290225 | A | | 11/1995 |
| JP | 8-141731 | A | | 6/1996 |
| JP | 2002-35918 | A | | 2/2002 |
| JP | 2002-035918 | A | | 2/2002 |
| SU | 1 097 432 | A | | 6/1984 |
| SU | 1 186 358 | A | | 10/1985 |
| SU | 1310097 | A | * | 5/1987 |

* cited by examiner

| | | | | |
|---|---|---|---|---|
| pressure [MPa] | 0.03 | 0.03 | 0.06 | gravity die cast |
| pressure rise [MPa/s] | 0.01 | 0.02 | 0.02 | |
| vacuum molding process | | | | |

METHOD AND DEVICE FOR POURING MOLTEN METAL IN VACUUM MOLDING AND CASTING

TECHNICAL FIELD

This invention relates to a pouring method, a device, and a cast in a vacuum molding process to produce a cast, especially, a thin-wall cast. Here, the vacuum molding process (hereafter, referred to "the vacuum sealed process") denotes a molding and pouring process that includes the steps of sealingly covering the surface of a pattern plate by a shielding member; placing a mold framing on the shielding member and then putting a fill that does not include any binder in the mold framing; sealingly covering the upper surface of the fill and then evacuating the inside of the mold framing to suck the shielding member to the fill to shape the shielding member; removing the pattern plate from the shielding member, thereby forming a mold half that has a molding surface; forming another mold half in a similar way and mating the mold halves to define a molding cavity; pouring molten metal in the molding cavity; and then releasing the negative pressure in the mold framing to take out a as-cast product.

BACKGROUND ART

Conventionally, the vacuum sealed process is widely used (for instance, see JP, S54-118216, A). However, the process were mainly used to produce thick-wall casts such as piano frames, counter weights, etc. and it was not used to produce casts that have thin walls of the thickness about 3 mm or less for instance.

Moreover, conventionally there was no device that cools the mold framing in the vacuum sealed process. The rise in temperature of the mold framing is confined after the pouring by continuing to evacuate the inside of the mold framing. However, in a step, the evacuation is stopped over a certain period of time, and the as-cast product, the mold framing, etc., are naturally cooled. When a product that has a large heat capacity such as a counter weight is cast, during the natural cooling the metal mold framing, the surface plate, etc., receive heat from the as-cast product, and hence their temperatures rise, thereby causing the films used to melt and adhere to the metal mold framing, the surface plate, etc.

The present invention has been conceived in view of the problems discussed above. A main purpose of this invention is to provide a pouring method and a device by using the vacuum sealed process, which are suitable for producing a cast, especially a thin-wall cast, and to provide a cast produced by using the pouring method.

Another purpose of this invention is to provide a device for cooling the mold framing.

SUMMARY OF THE INVENTION

To that end, in one aspect of the present invention the pouring method in the vacuum sealed process is characterized in that the molding cavity is evacuated through the mold framing. That is, although in the usual vacuum sealed process the inside of the mold framing is intercepted by a shield member from the molding cavity that communicates with the atmosphere, and the inside of the mold framing is evacuated to suck the shielding member to the fill to shape the shielding member and to maintain the molding cavity, in the vacuum sealed process of the present invention such a shielding member used in the usual vacuum sealed process is removed to allow the inside of the mold framing and the molding cavity, which communicates with the atmosphere, to communicates with each other (although this communication may be considered to collapse the sand mold). With the communication being kept, the mold half and the molding cavity are maintained to produce a cast.

Further, in the above-mentioned aspect a step of evacuating the molding cavity is performed through the mold framing. It is characterized in that this step is carried out through vent plugs after the steps of placing the shielding member, disposing the vent plugs in the model part of pattern plate, placing the mold framing on the shielding member and the vent plugs, and filling the fill in the mold framing.

In addition, it is characterized that the step of evacuating the molding cavity through the mold framing in the one aspect is performed through a plurality of vent holes formed in the shielding member after the mold half is produced.

Moreover, it is characterized that the pouring method of the vacuum sealed process in the one aspect further comprises the steps of measuring the degree of a pressure reduction for at least one of the mated mold halves between the start and the completion of pouring; transferring the measured degree of the pressure reduction to a controller; and adjusting the degree of pressure reduction in the mold half and molding cavity.

In addition, it is characterized in the one aspect that the mold half is not provided with an open top riser. An open top riser functions to discharge air and slag of the molten metal, and hence it has been used to stably produce a cast that is not deformed. It was found that when the molding cavity is evacuated appropriately without using an open top riser in this invention, the flow of molten metal is improved and the molten metal can be effectively filled in the molding cavity before the deformation of the sand mold occurs.

According to the one aspect of the present invention, since the molding cavity is evacuated in the vacuum sealed process (this is performed through at least one of the mold framing and the open top riser), a thin-wall cast can be produced by the vacuum molding process. Moreover, since the inside of the mold and the molding cavity are simultaneously evacuated due to the vent holes, an additional device is not required for evacuating the molding cavity, proving an advantage in that the structure of the molding machine can be simple. When the open top riser is not provided, a feeder head or throwing-away part for the molten metal can be assumed to be a minimum requirement. As a result, there is an advantage that the product yield improves.

In addition, since this invention keeps the feature of the usual vacuum sealed process, it has an advantage in that the mold framing can be easily removed and that an as-cast thin-wall product can easily taken out.

According to another aspect of the present invention, to achieve the above-mentioned purpose, the pouring method of the vacuum sealed process is characterized in that the lower mold half (drag) of the mated mold is formed with a gate, while the upper mold half (cope) is not formed with any gate.

Moreover, the method is characterized in that the cope of the mated mold, which is positioned above a hold furnace, is adjusted so as to be kept horizontally.

In addition, the method is characterized in that the pouring is carried out by using cushion means disposed between the mated mold and the holding furnace for keeping the cope of the mated mold horizontally.

Moreover, to achieve the above-mentioned purpose, the pouring method of vacuum sealed process of this invention is characterized in that the pouring is carried out with a heat insulating material being disposed between the mated mold and the holding furnace when the mated mold is disposed above the holding furnace.

In addition, it is characterized in that a sand layer that functions as the heat insulating material communicates with a stoke at a lower part and is connected with a plurality of gates at an upper part.

Moreover, to achieve the purpose, the pouring method of the vacuum sealed process of this invention is characterized in that it is the low pressure die casting or the differential pressure die casting.

In addition, the pouring method is characterized in that when molten metal is poured in the molding cavity, the pouring rate is controlled.

According to the another aspect of the invention, since a gate is formed only in the lower mold half of the mated mold (it is not formed in the upper mold half), this allows molten metal to be poured from below, where the flow of the molten metal becomes a laminar flow, entraining less air and slag to the molten metal compared with the gravity die casting and the die casting. Moreover, since a riser and a feeder head need not be provided, the throwing-away part for the molten metal can be assumed to be a minimum requirement. As a result, there is an advantage that the product yield improves. In addition, since this invention keeps the feature of the usual vacuum sealed process, it has an advantage in that the mold framing can be easily removed and that an as-cast thin-wall product can easily taken out.

This invention is suitable for producing large thin-wall casts such as framings for large household electrical appliances, large televisions, cars, and machinery. Any material of metal may be used.

In the two aspects of the invention discussed above, cooling means by spraying compressed air on the mold framing for cooling it can be used.

These and other purposes, features, and advantages will be clear from the following descriptions about the embodiments referred to with reference to the accompanying drawings.

PREFERRED EMBODIMENTS OF THE INVENTION

Figure 1:
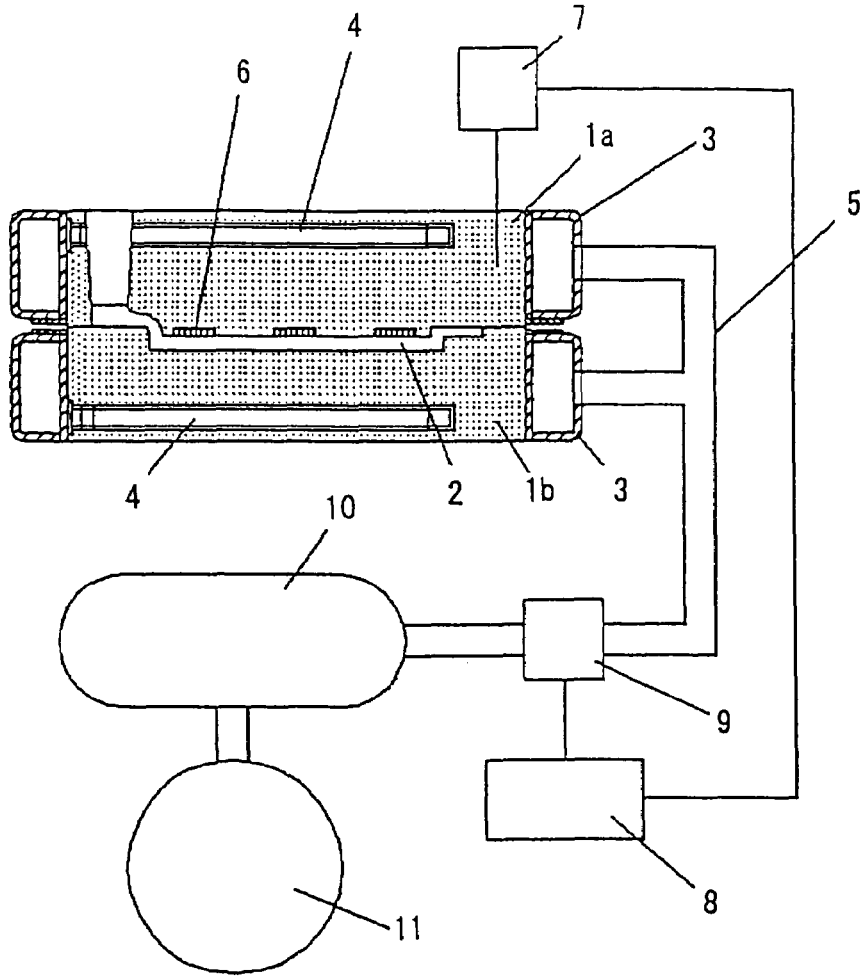
FIG. 1 is a schematic cross-sectional view of the first embodiment of this invention.

The preferred embodiment of this invention is now described. In some embodiments, the same or similar numbers are used for the same or similar elements.

This invention of the vacuum sealed process is characterized in that vent holes are used to allow the molding cavity to communicate with the inside of the mold, and in that the molding cavity is evacuated through the mold framing.

That is, the invention is a pouring process in the vacuum sealed process, the process including the steps of sealingly covering the surface of a pattern plate by a shielding member; placing a mold framing on the shielding member and then putting a fill that does not include any binder in the mold framing; sealingly covering the upper surface of the fill and then evacuating the inside of the mold framing to suck the shielding member to the fill to shape the shielding member; removing the pattern plate from the shielding member, thereby forming a mold half that has a molding surface; forming another mold half in a similar way and mating the mold halves to define a molding cavity; pouring molten metal in the molding cavity; and then releasing the negative pressure in the mold framing to take out a as-cast product. The process includes the step of evacuating the molding cavity through the mold framing before pouring the molten metal in the molding cavity and it is characterized in that Pm=1-75 kPa, Pc=1-95 kPa, and Pc−Pm=3-94 kPa when the internal pressure of the mold and the pressure in the molding cavity are assumed to be Pm and Pc, respectively, when the molten metal is poured in the molding cavity.

Here, the purpose of assuming mold internal pressure Pm to be 1-75 KPa is that if is less than 1 KPa, a huge vacuum pump is required, and that if it is more than 75 KPa, it is not possible to suck the gas generated at the pouring. Further, the purpose of assuming the molding cavity internal pressure Pc to be 1-95 KPa is that if it is more than 95 KPa, a smooth inflow of the molten metal cannot be assured since the differential pressure with atmospheric pressure (101.3 KPa) is not enough, and that if it is less than 1 KPa, the mold may collapse toward the molding cavity. In addition, it is necessary to assure Pc>Pm, because making the mold internal pressure Pm to be a degree of pressure reduction lower than molding cavity internal pressure Pc prevents the molten metal from penetrating the mold. Moreover, the value of Pc−Pm, which is defined by Pc and Pm, must be 3-94 KPa.

Here, the mold framing denotes a flask, or flask assembly, provided with a suction pipe used in the vacuum sealed process.

Moreover, in this-invention the vent holes may be formed by distributing the vent plugs in the pattern part after the film is shaped, and then by molding, and then by cutting the film along the slits of the vent plugs from the molding cavity side after remolding. Alternatively, the vent holes may be formed by making holes, by a needle from the molding cavity side, which holes reach the inside of the mold.

In addition, in this invention the open top riser may be eliminated by moderately decompressing the molding cavity as mentioned above. The open top riser is a tubular void that passes through the cope to connect the molding cavity to the atmosphere. Accordingly, if no open top riser is provided, there will be no communication hole in the upper part of the cope connecting the molding cavity to the atmosphere.

The First Embodiment

Figure 2:
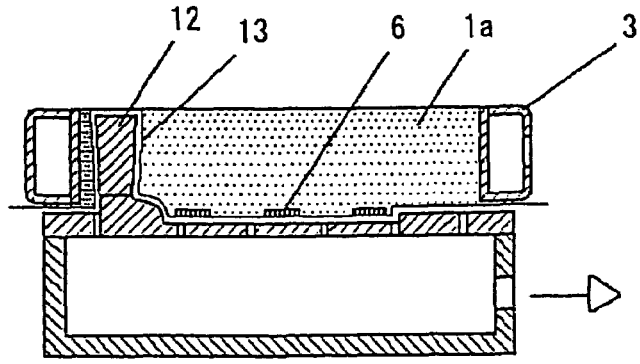
FIG. 2 shows the outline of the method of the first embodiment.

Here, the first embodiment is explained in relation to FIGS. 1 and 2.

FIG. 1 is a schematic sectional view of a device for the vacuum molding process used for the embodiment. Upper and lower mold halves 1*a* and 1*b*, which were produced by using the vacuum sealed process, are mated to define a molding cavity 2.

Here, the method of producing the mold halves 1*a* and 1*b* is described in detail on the basis of FIG. 2. In FIG. 2, the surface of the pattern plate 12 is sealingly covered by a film 13 (a shielding member) by applying negative pressure to the surface. A flask 3 (a mold framing) is then placed on the film 13, and vent plugs 6 (as vent holes) are appropriately disposed at an upper mold half side according to the pattern configuration. Afterwards, molding sand is filled in the flask, to produce the upper mold half 1*a*. Next, the upper mold half 1*a* is separated from the pattern plate 12, and the film 13 is cut at the slits of the vent plugs 6. Thus the mold half 1*a* is produced with the vent holes being formed with the cuts in the film and the associated vent plugs 6.

A lower mold half 1*b*, which has been produced in a manner similar to the upper mold half 1*a*, is mated with it to form a mated mold having a molding cavity (FIG. 1). At this time, the molding cavity 2 communicates with the inside of the mold framing (flasks 3) and with the atmosphere through runners and a gate. Although in this embodiment no vent plug, or vent hole, is provided in the lower mold half 1*b*, some vent plugs 6 may be provided when appropriate. Thus a device of the vacuum molding process is formed as shown in FIG. 1.

Next, the operation of that device of the vacuum molding process is described. In FIG. 1 the inside of upper and lower mold halves 1*a* and 1*b* has been decompressed by a decompression pump 11 through the flasks 3, suction pipes 4 and 4, a piping 5, and a reservoir tank 10.

Moreover, the molding cavity 2, together with the mold halves 1*a* and 1*b*, is decompressed through the vent plugs 6 (vent holes). The pressure in the inside of the mold halves 1*a* and 1*b* is detected by a pressure sensor 7, and the detection pressure is sent to a controller 8. A control signal corresponding to the detected pressure is sent by this controller 8 to a proportional control valve 9 to adjust its degree of opening as required to change the sucking pressure in the mold halves 1*a*, 1*b* and the molding cavity 2. Under this state, an aluminum alloy molten metal is poured in the molding cavity 2. Over a period of time, the negative state in the inside of the mold framing is released, and an as-cast product is taken out. This product was not defective in the thin wall of 3 mm or less.

Clearly from the above explanation, this invention can produce a cast under decompressed state by applying the vent plugs 6 (vent holes) that allow the molding cavity 2 to communicate with the inside of the mold halves 1*a* and 1*b* to the conventional vacuum sealed process mold.

Second Embodiment

Figure 3:
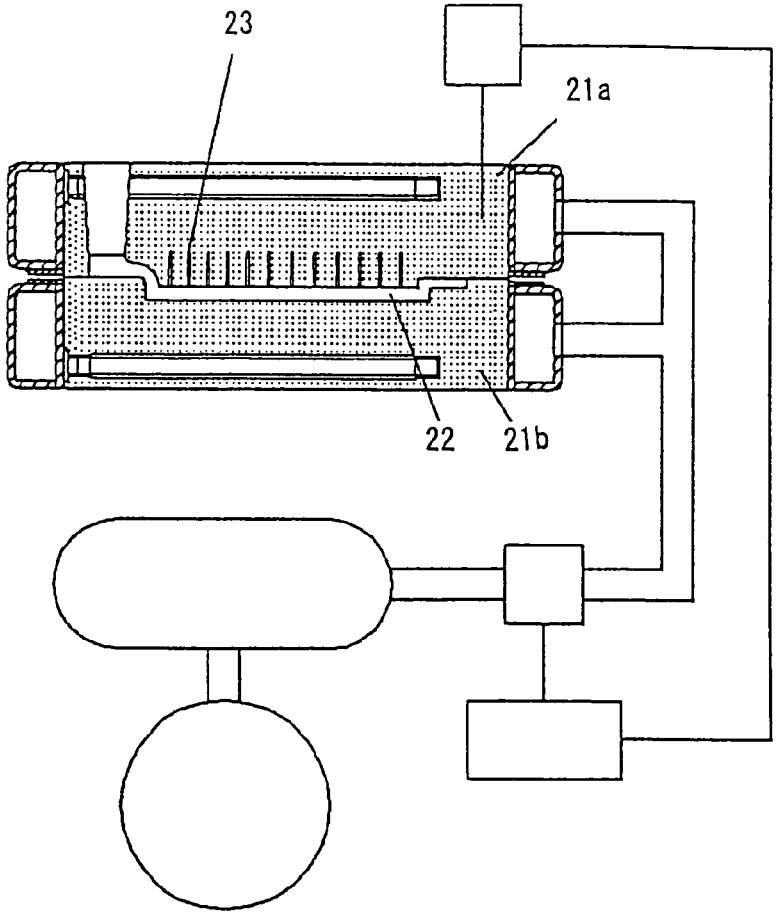
FIG. 3 is a schematic cross-sectional view of the second embodiment of this invention.
Figure 4:
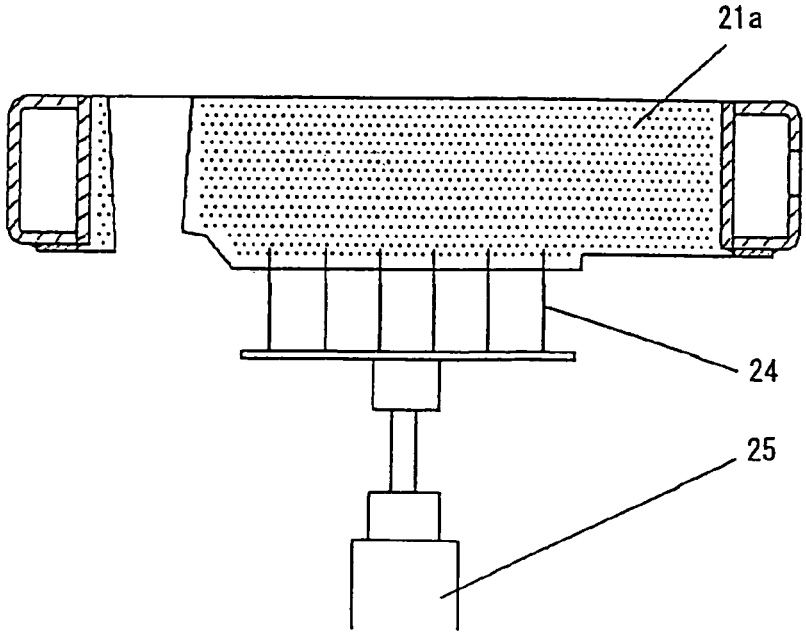
FIG. 4 shows the outline of one stage of the second embodiment.

Next, another embodiment (the second embodiment) that uses this invention is described with reference to FIGS. 3-5. FIG. 3 shows an example to form vent holes by needles, which holes pass the inside of the upper mold half. Upper and lower mold halves 21*a* and 21*b* have been produced by the vacuum sealed process. Next, needles pass through the film from a molding cavity 22 side into the upper mold half 21*a* to form vent holes 23. This is carried out as shown in FIG. 4. That is, a tool having needles 24 are moved by a drive 25, to form the vent holes in the mold half at one time. The position of needles 24 have been previously set under the control by a computer for the places where the flow of molten metal is assumed to be bad and where a casting configuration part is far from the gate.

Moreover, vent holes 23 may be manually formed for simplifying the device or when the number of vent holes is less. Although no vent hole is formed in the lower mold half 21*b* in this embodiment, some may be formed according to circumstances. Afterwards, the mold halves 21*a* and 21*b* are mated to form a mated mold having a molding cavity 22 (FIG. 3). By adjusting pressure conditions so that the internal pressure Pm in the mold halves 21*a* and 21*b* is kept as Pm=1-75 KPa and the internal pressure Pc of the molding cavity 22 as Pc=1-95 Kpa, the pouring was carried out.

Figure 5:
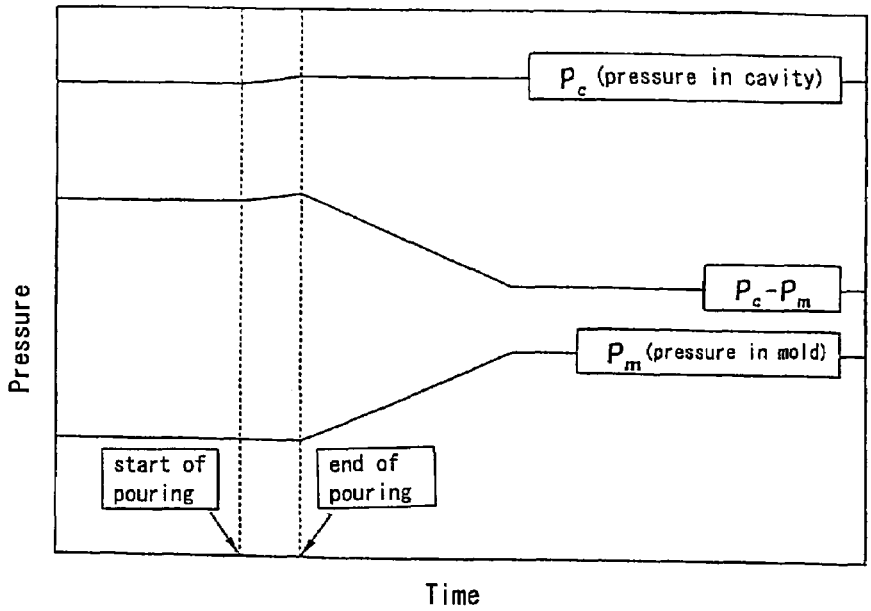
FIG. 5 shows a pressure diagram of the second embodiment.

FIG. 5 shows the example of pressures in the mold halves 1*a*, 1*b* and the molding cavity 2 in this embodiment.

To assure a smooth inflow of the molten metal, the inner pressure Pc in the molding cavity 2 needs an enough pressure differential with the atmospheric pressure. Further, if Pc−Pm is too small, the mold may collapse, and if Pc−Pm is too large, the vacuum equipment must be large since Pm becomes small, yielding a high cost.

From the above-mentioned reasons and the experimental result, it has been found that the conditions of Pm=1-75 KPa, Pc=1-95 KPa, and Pc−Pm=3-94 KPa are effective.

In addition, the change in pressure is described in detail. The internal pressure Pm in the mold halves 1*a* and 1*b* is kept as a high degree of pressure reduction between the start and the end of the pouring for causing a good flow of the molten metal by the pressure reduction and for sucking gas generated by the burning of the shaping film.

After the pouring, where the molding cavity 2 is filled with the molten metal, the pressure sensor 7 detects the internal pressure Pm in the mold halves 1*a* and 1*b* and sends it to the controller 8. The controller 8 adjusts the opening of the proportional control valve 9 to adjust the internal pressure Pm in the mold halves 1*a* and 1*b* to a low degree of pressure reduction, to prevent the molten metal from penetrating the mold.

The Third Embodiment

Figure 6:
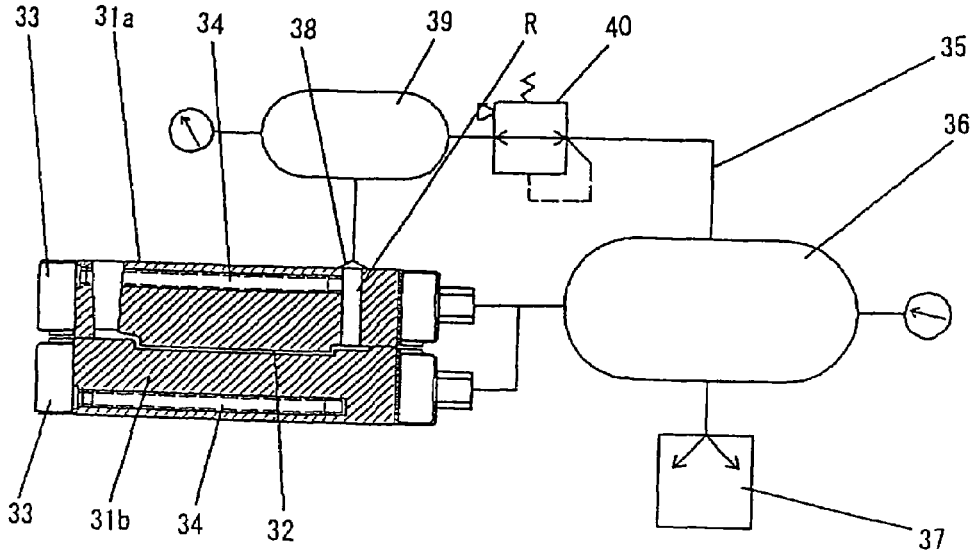
FIG. 6 is a schematic cross-sectional view of the third embodiment of this invention (an example of evacuating the molding cavity through an open top riser).

FIG. 6 shows one example of the method of decompressing the molding cavity by using an open top riser R. The upper and lower mold halves 31*a* and 31*b*, which have been produced by using the vacuum sealed process, are mated to define the molding cavity 32. The inside of the mold halves 31*a* and 31*b* is decompressed by a decompression pump 37 through the flasks 33 and 33, suction pipes 34 and 34, a piping 35, and a reservoir tank 36.

Moreover, the upper mold half 31*a* is provided with the open top riser R, which communicates with the molding cavity 32 and is opened to the upper surface of the upper mold half 31*a*. The riser R also acts as a feeder head. Further, the lower mold half 31*b* is provided with a flat gage (not shown) that connects the molding cavity 32 and the open top riser R.

The molding cavity 32 is decompressed by a decompression pump 37 through a tool 38 connected to the opening of the open top riser R, which opening is located in the upper surface of the upper mold half 31*a;* a reservoir tank 39 for decompressing the molding cavity; a pressure regulating valve 40; and a reservoir tank 36.

By adjusting the pressure conditions so that the internal pressure Pm in the mold halves 31*a* and 31*b* and the internal pressure Pc of the molding cavity 32 are maintained as Pm=1-75 KPa and Pc=1-95 Kpa, respectively, the pouring was carried out.

AN EXAMPLE FOR COMPARISON

Figure 7:
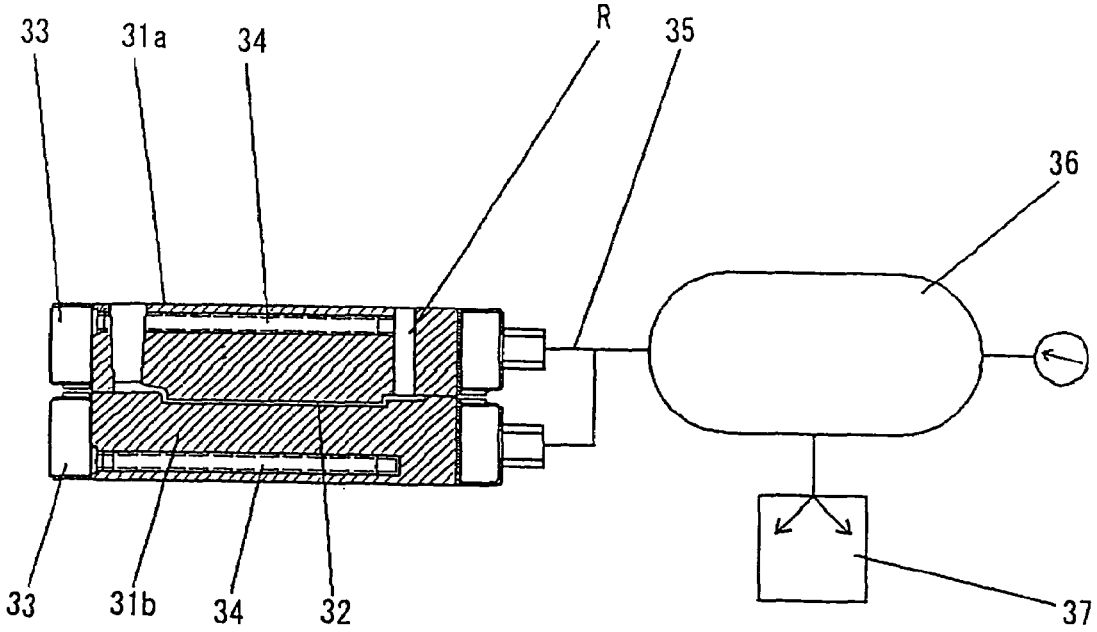
FIG. 7 is a schematic cross-sectional view showing another pouring method (of a prior art) for comparison.

FIG. 7 shows one example of the mold provided with the open top riser R, where the molding cavity is not decompressed. The upper and lower mold halves 31*a* and 31*b,* which have been produced by the vacuum sealed process, are mated to define the molding cavity 32. The inside of the mold halves 31*a* and 31*b* has been decompressed by a decompression pump 37 through the flasks 33 and 33, suction pipes 34 and 34, a piping 35, and a reservoir tank 36.

Moreover, the upper mold half 31*a* is provided with the open top riser R, which communicates with the molding cavity 32 and is opened to the upper surface of the upper mold half 31*a*. The riser R also acts as a feeder head. Further, the lower mold half 31*b* is provided with a flat gage (not shown) that connects the molding cavity 32 and the open top riser R. In the mold framing configured as mentioned above, pouring was carried out with the molding cavity not been decompressed.

Figure 8:
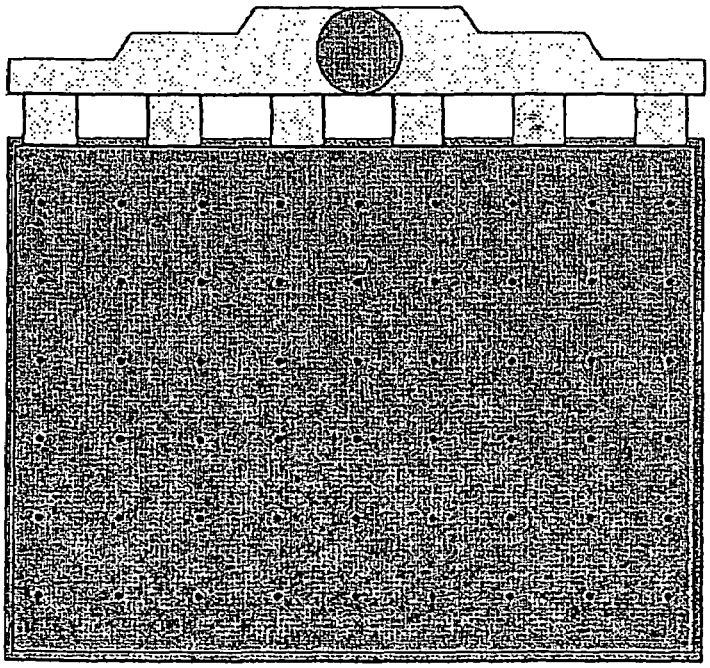
FIG. 8 shows the result by the second embodiment of this invention.
Figure 9:
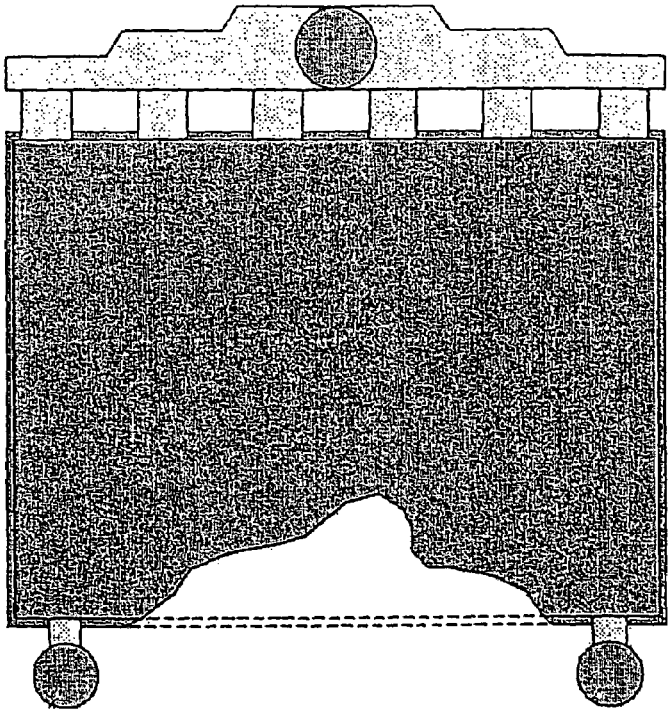
FIG. 9 shows the result by the third embodiment of this invention.
Figure 10:
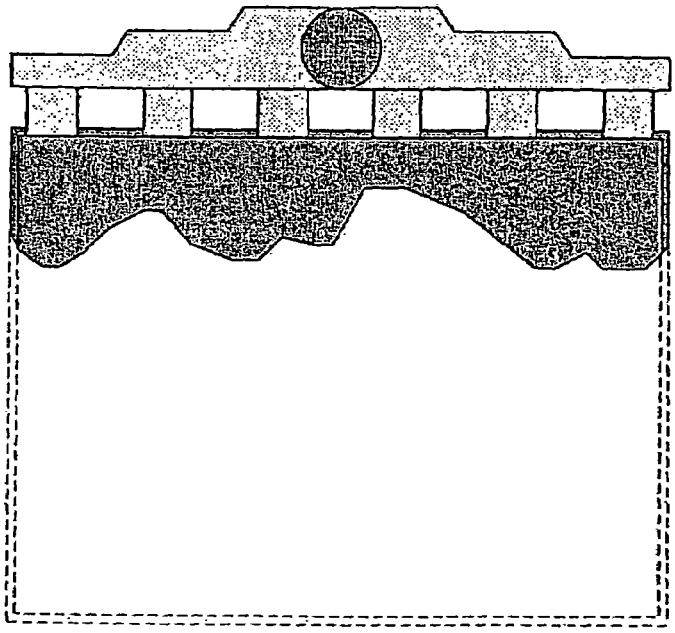
FIG. 10 shows the result of pouring by the prior-art method for comparison.

FIGS. 8-10 are schematic diagrams showing the results of pouring. These schematic diagrams show the photograph of the results of pouring in the imitative manner.

FIG. 8 shows the result of the pouring carried out by the method of the second embodiment. FIG. 9 shows the result of the pouring carried out by the method of the third embodiment. FIG. 10 shows the result of the pouring carried out by the method of the reference example for comparison.

As shown in FIG. 10, it is understood that when the molding cavity is not decompressed as in the example for comparison, the molten metal is filled only partially in the molding cavity near the flat gate. In the result shown in FIG. 9 for the third embodiment of the pouring method of the present invention, the molten metal has reached the area where the open top riser R is located, thus the effect of decompressing the molding cavity is seen in comparison with the reference example. However, the area at which no open top riser is located is not filled with the molten metal, and thus the as-cast product is not good. In FIG. 8 for the pouring method of the second embodiment of the present invention, the entire molding cavity is filled with the molten metal. Thus a greater effect of decompressing the molding cavity is seen than the result of the third embodiment.

Clearly from this result, the advantage of the use of this invention can be confirmed.

TABLE 1

| | Degree of Filling | Casting Cost | Operability |
|---|---|---|---|
| Hole by needle | very good | very good | good |
| Vent hole | good | average | average |
| Open top riser | average | average | good |

In Table 1 three methods are shown to allow the molding cavity to communicate with the mold framing for decompressing the molding cavity. One is making holes by needles, one is to use vent holes, and the other is to use the open top riser. The degree of filling of the molten metal, the casting cost, and the operability of molding of these methods are compared in Table 1. The method using the needles shows better result than two other methods.

The Fourth Embodiment

Next, the fourth embodiment of this invention is described with reference to FIGS. 11-16. This invention is characterized in that the pouring is carried out with the mated mold produced using the vacuum sealed process being disposed above a holding furnace. That is, in the pouring method of the vacuum sealed process, a gate is formed at the lower mold half, and no gate is formed at the upper mold half. Further, the pouring method is also characterized in that heat insulation means are disposed between the mated mold and the holding furnace. Further, the lower surface of the lower mold half is made flat.

Here, providing no gate at the upper mold half means that the pouring is carried out from below, since the gravity die cast, which is used for the vacuum sealed process, is not used, but the low pressure die cast or the pressure differential die cast is used for pouring. Thus the mated mold is located above the holding furnace.

The heat insulating means acts for preventing the film (the shielding member) from being melt due to the heat from the holding furnace. The heat insulating means includes heat insulating material disposed between the lower mold half and a lower die plate on which the lower mold half is placed. Alternatively, the heat insulating material may be partly inserted in the lower die plate. The material of the heat insulation may be any one that can resist the temperature of the molten metal such as earthenware, ceramics, gypsum, a sand mold, and a of self hardening sand mold, etc.

To adjust the lower mold half so that it is kept horizontal denotes proving cushion member or filling material between the lower mold half or the heat insulating material and the lower die plate to prevent the molten metal from being escaped due to a gap caused when the bottom of the lower mold half or it is not horizontal, or it denotes operating any machinery (a scraper, vibrator, etc.) to flatten the filling material. The material for this cushion member may be soft material to fit the bottom shape of the lower mold half and that is durable to the temperature of the molten metal, such as glass wool and sand. Composite materials are acceptable.

Figure 11:
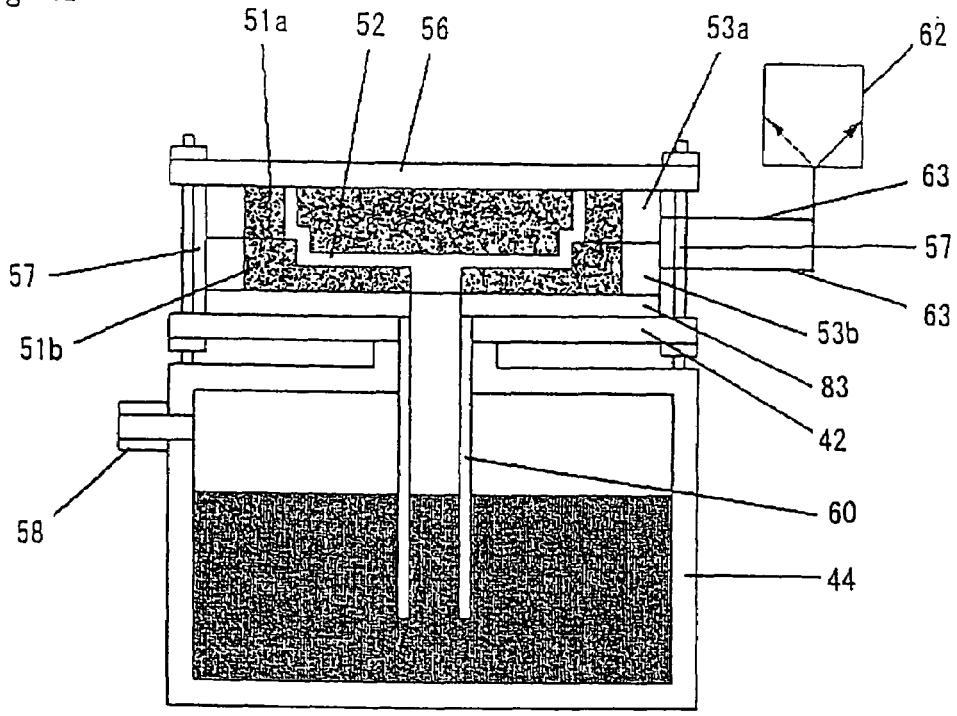
FIG. 11 is a schematic cross-sectional view of the fourth embodiment of this invention.

FIG. 11 is referred first. FIG. 11 is a schematic view of the embodiment of the vacuum molding process device of this invention. As shown in FIG. 11 this device comprises a holding furnace 44 for holding molten metal; a lower die plate 42 placed on the holding furnace 44; a heat insulation 83 as heat insulating means placed on the lower die plate 42; flasks 53*a,* 53*b* placed on the heat insulation 83; an upper and lower mold halves 51*a,* 51*b,* which have been produced using vacuum seal process, and which are placed in the flasks 53*a,* 53*b;* an upper die plate 56 placed on the upper mold half 51*a;* and four rods 57 uprightly disposed on the upper surface of the holding furnace at it four corners.

A compressed air introduction tube 58 to introduce compressed air into the holding furnace 44 is attached to the holding furnace. Moreover, the mated upper and lower mold halves 51*a* and 51*b* define a molding cavity 52. In addition, a stoke 60 is attached to the die plate 42 for introducing the molten metal from the holding furnace 44 into the molding cavity 52. Moreover, the heat insulation 83 is formed with an aperture at a position under the lower mold half 51*b,* corresponding to the gate, through which aperture the molten metal passes.

Now, the operation of the vacuum molding process device of this embodiment is described. In FIG. 11 the inside of the upper and lower mold hales 51*a* and 51*b* is decompressed, and the inside of the flasks 53*a* and 53*b* has been decompressed by the decompressing device 62 through the flasks 53*a,* 53*b* and the suction pipes 63 and 63. The upper and lower mold halves 51*a* and 51*b* are placed on the heat insulating materials 83, and the upper die plate 56 is placed on the upper mold half 51*a.* Next, the heat insulating materials 83 and the upper and lower mold halves 51*a* and 51*b* are sandwiched and clamped between the upper die plate 56 and the lower die plate 42.

Afterwards, compressed air is introduced from a compressed air source (not shown) into the holding furnace 44 through the compressed air introduction tube 58, to apply a pressure on the surface of the molten metal, to raise the molten metal in the stoke 60 to fill the molding cavity 52 with the molten metal. After the molten metal in the molding cavity 52 hardened, the introduction of compressed air was stopped, and the pressure in the holding furnace 44 was returned to the atmospheric one. Thus extra molten metal in gate and stoke 60 returned in the holding furnace 44, and thus the pouring was ended.

Since in the vacuum molding process device of this embodiment the holding furnace is disposed just under the mold, the installation space for the device can be minimized. Although in this embodiment neither a feeder head nor a riser is used, they may be used when desired. Further, although the molten metal is supplied by introducing compressed air in this embodiment, it may be supplied using an electromagnetic pump etc. or using any other methods.

Figure 12:
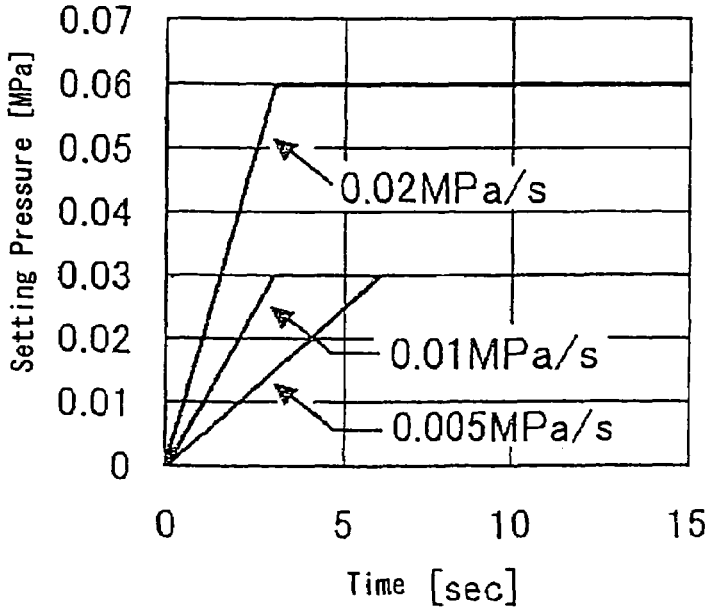
FIG. 12 shows the pressure condition of the pouring test in the fourth embodiment.

Next, the pouring test carried on the vacuum molding process device of this embodiment is described. In the pouring test a molten aluminum is poured into the molding cavity 52, and the total length that is the length of the molten metal filled in the molding cavity 52 and the length of the good part that had been filled well were measured. FIG. 12 shows the pressure condition in the pouring test of the compressed air for pressurizing the inside of the holding furnace 44. The final target setting pressures are 0.03 and 0.06 MPa, and the pressure raising rates are 0.01 and 0.02 MPa/s.

Figure 13:
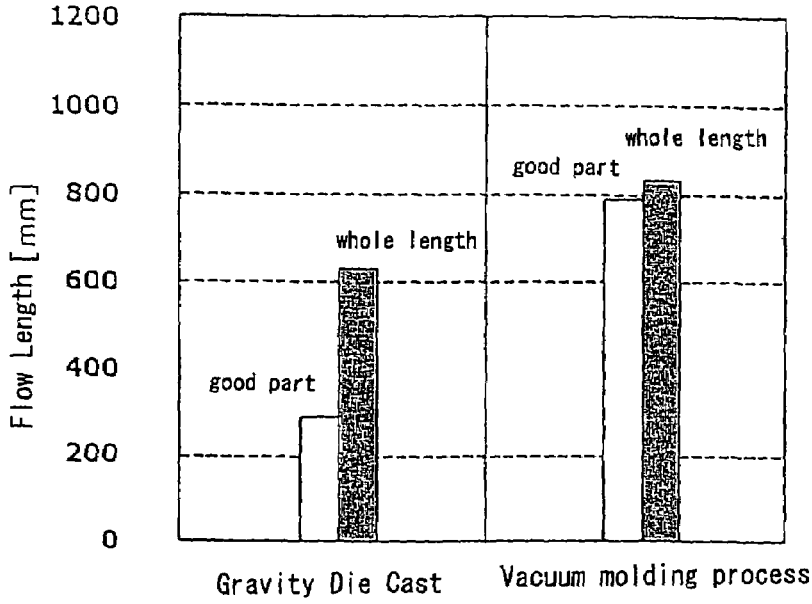
FIG. 13 shows a result of the flow length of the pouring test in the fourth embodiment.

FIG. 13 shows the result of the measured lengths of the total length that is a length of the molten metal filled in the molding cavity 52 and the length of a good part that is well filled, where the thickness of the molding cavity 52 is 3 mm. The pressure raising rate in the holding furnace 44 was 0.01 MPa/s, and the final target setting pressure was 0.03 MPa. FIG. 13 also shows the result of an example for comparison, where the gravity die cast was performed using a mold produced by the conventional vacuum sealed process. It is clear from FIG. 13, both the total length and the length of the good part in the embodiment of the vacuum molding process device are longer than those in the comparison example.

Figure 14:
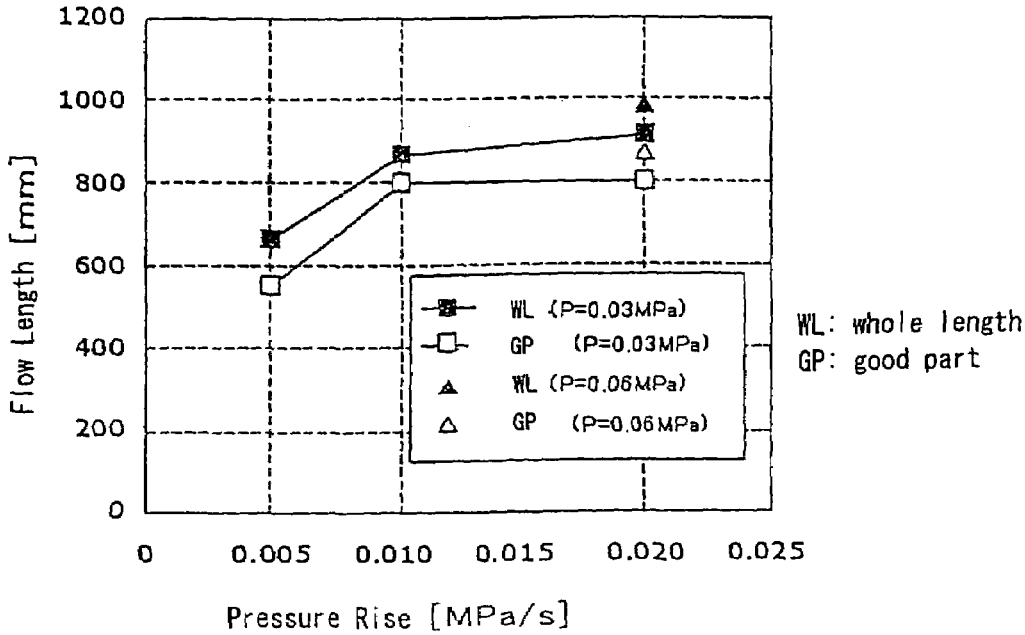
FIG. 14 shows another result of the flow length of the pouring test in the fourth embodiment.

FIG. 14 shows the result of the measured lengths of the total length that is a length of the molten metal filled in the molding cavity 52 and the length of a good part that is well filled, where the thickness of the molding cavity 52 is 3 mm. The final target setting pressure was 0.03 Mpa, and the pressure raising rates in the holding furnace 44 were 0.005, 0.01, and 0.02 MPa/s.

It is seen from FIG. 14 that there is a tendency that both the total length and the length of the good part become longer as the pressure raising rate become greater, and that the changes in these lengths become small when the pressure raising rate exceeds 0.01 MPa/s. Thus, from the result of this test, the pressure raising rate is preferably 0.01 MPa/s.

Figure 15:
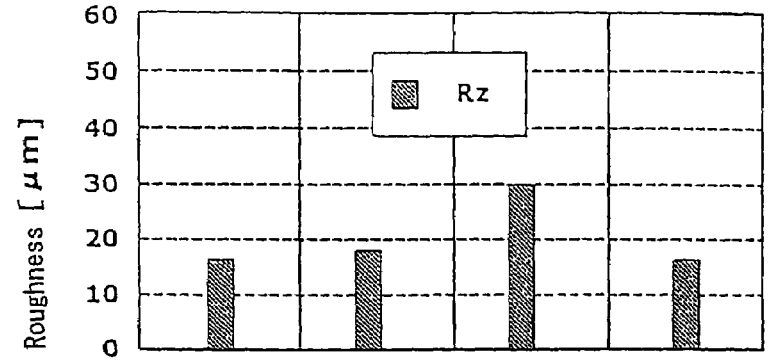
FIG. 15 shows the result of the surface roughness of the pouring test in the fourth embodiment.

Next, FIG. 15 shows the result of the measured surface roughness of the produced casts. FIG. 15 also shows the result of an example for comparison, where the gravity die cast was performed using a mold produced by the conventional vacuum sealed process. The part where the surface roughness was measured is a part where the molten metal flows from the runner into the molding cavity 52 in FIG. 11.

As understood from FIG. 15, there was no difference between the comparison example using the gravity die cast and the vacuum sealed process device of this embodiment when the final target setting pressure of the compressed air that pressurizes the inside of the holding furnace 44 was 0.03 MPa. However, when the final target setting pressure of the compressed air for pressurizing the inside of the holding furnace 44 was 0.06 MPa, the numerical value of the surface roughness became greater, showing that the surface roughness became rough. It is considered that this is caused by the pressure of the molten metal, which became greater and allowed the molten metal to penetrate the mold.

Figure 16:
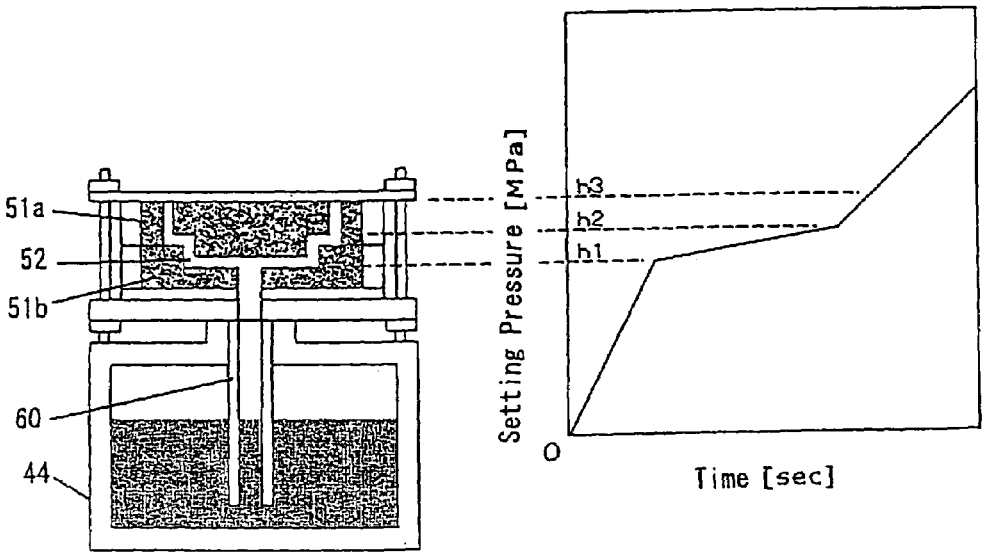
FIG. 16 shows an example of the pressure control of the pouring test in the fourth embodiment.

Next, FIG. 16 shows the example of the pressure control during the pouring of the molten metal in this embodiment. As shown in FIG. 16, the upper and lower mold halves 55*a* and 55*b* are mated to define the molding cavity 52. By pressurizing the upper surface of the molten metal in the holding furnace 44, the molten metal rises in stoke 60 and is poured in the molding cavity 52. In the graph in the right of FIG. 16 the point to start pressurizing with compressed air the surface of the molten metal in holding furnace 44 is assumed to be 0. The setting pressure P of the compressed air for pressurizing the surface of the molten metal in the holding furnace 44 and the height h that the molten metal can attain to are expressed as an equation, $P=\rho bh$.

Therefore, since the height of the molten metal changes rapidly until the molten metal reaches the position h1 at which the molten metal flows from the gate into the molding cavity 52 as shown in FIG. 16, it is necessary to make great the pressure raising rate of the setting pressure P of the compressed air for pressurizing the inside of the holding furnace 44. Next, when the flat part of the molding cavity 52, i.e., the part from level h1 to level h2, is filled with the molten metal, it is necessary to make less the pressure raising rate of the setting pressure P of the compressed air for pressurizing the inside of the holding furnace 44. Because, the part from level h1 to level h2 is a product part, and the flow of the molten metal becomes a turbulent one if the rate is great, therefore the molten metal concentrates at a part of the film (the shielding member) and contacts with that part, thereby causing its fall due to a partial burning and hence a partial fall of the mold. The less rates also prevents the generation of the slag entrainment in the flow, which would be caused by such a turbulent flow.

Moreover, since at the part from level h2 to h3 the height of the molten metal changes rapidly the same as in the part up to the level h1, the pressure raising rate of the setting pressure P of the compressed air for pressurizing the inside of the holding furnace 44 should be made great.

The Fifth Embodiment

Figure 17:
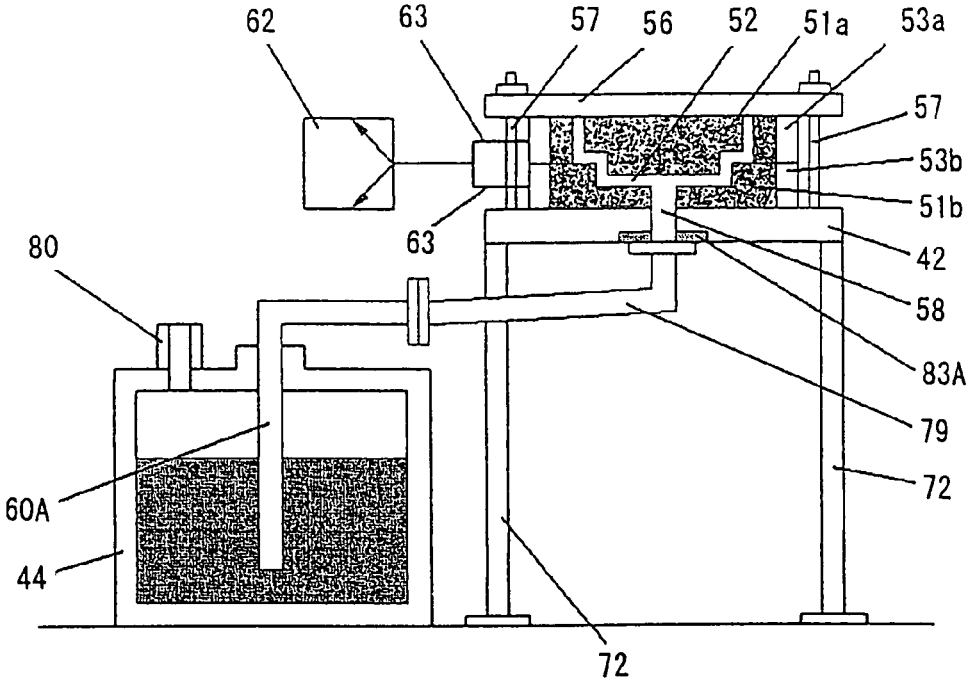
FIG. 17 is a schematic cross-sectional view of the fifth embodiment of this invention.

Next, the fifth embodiment of this invention is described on the basis of FIG. 17.

FIG. 17 is a schematic view of another embodiment of the vacuum sealed process device. As shown in the drawing, this vacuum sealed process device comprises a holding furnace 44 for holding molten metal, four upright props 72 disposed at the side of the holding furnace 44, a lower die plate 42 mounted on the tops of the props 72 and 72, flasks 53*a* and 53*b* placed on the lower die plate 42, an upper and lower mold halves 51*a*, 51*b*, which have been produced using the vacuum seal process and placed in the flasks 53*a* and 53*b*, respectively, an upper die plate 56 placed on the upper surface of the upper mold half 51*a*, and a pipe 79 for allowing the holding furnace 44 to communicate with an inlet 58 formed at the bottom of the lower die plate 56 for the introduction of the molten metal. The four upright props 72 support the lower die plate 42 at its four corner.

The holding furnace 44 is provided with a compressed air introduction tube 80 to introduce compressed air into the holding furnace. Moreover, the upper and lower mold halves 51*a* and 51*b* are mated to define a molding cavity 52.

In addition, stoke 60A that communicates with the pipe 79 to introduce the molten metal in the holding furnace 44 into molding cavity 52 is attached to the die plate 42. Moreover, the lower die plate 42 is formed with an aperture at a position corresponding to the gate of the lower mold half 51*b* for communicating with the pipe 79. Further, a heat insulation 83A is disposed around the aperture.

Next, the operation of the vacuum molding process device of this embodiment is described. In FIG. 17 the inside of the upper and lower mold halves 51*a* and 51*b* has been decompressed by pressure decompressing device 62 through the flasks 53*a*, 53*b* and suction pipes 63 and 63. The upper and lower mold halves 51*a* and 51*b* were placed on the lower die plate 42, and the upper die plate 56 was placed on the upper mold half 51*a*. Next, the upper and lower mold halves 51*a* and 51*b* were sandwiched clamped between the upper and lower die plate 56 and 42. Afterwards, compressed air was introduced from an compressed air source (not show) into the holding furnace 44 through the compressed air introduction tube 80 to apply pressure on the surface of the molten metal. Thus the molten metal rose in the stoke 60A and the pipe 79, and the molding cavity 52 was filled with it. The introduction of compressed air was stopped after the molten metal in the molding cavity 52 hardened, and thus an extra molten metal in the gate, pipe 79, and stoke 60A returned into the holding furnace 44 as the pressure in the holding furnace 44 returned to the atmospheric pressure. Thus the pouring was completed.

Since in the vacuum molding process device of this embodiment the mold is not disposed above the holding furnace, supplying molten metal in the furnace and removing detritus such as slag and oxides existing in the surface of the molten metal from the furnace can be performed easily. Although in this invention no feeder head or riser is use, they may be used if desired.

Figure 18:
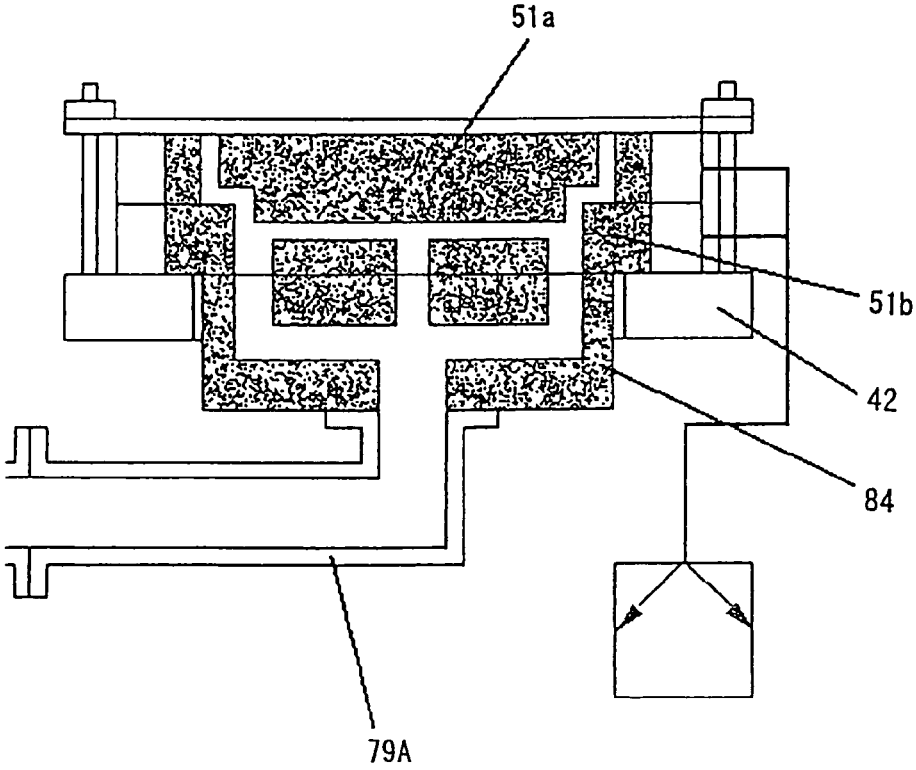
FIG. 18 shows an alternative embodiment of a pouring tool of this invention.

Moreover, although in this embodiment the molten metal is fed by using compressed air, it may be done using an electromagnetic pump, etc. or by any other methods. As shown in FIG. 18, the molten metal may be supplied to a level under the die plate 42 by a pipe 79A, and a sand layer or block 84, which has passage therein for the molten metal, is attached to one end of the pipe 79A, which end faces the lower mold half 51*b*. Using this sand block 84 can feed the molten metal to the plurality of gates simultaneously. Therefore, it gives easy applications to a cast having a complicated shape and to a cast having a plurality of casting pieces. When the position of gates is chained due to the change of the casting plan, a sand block 84 may be formed that has passages for molten metal corresponding to the position of the gates. Using such a sand block 84 gives easy application to such a change of the position of gates. Although in the embodiment shown in FIG. 18 the sand block 84 is connected to the pipe 79A, it may be connected to the stoke directly.

The Sixth Embodiment

Figure 19:
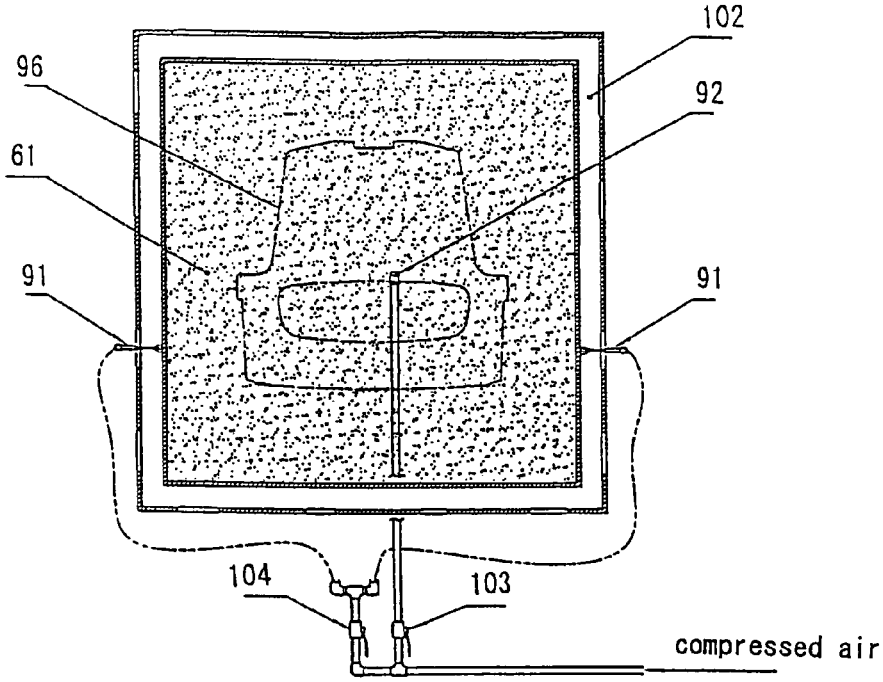
FIG. 19 is a sectional plan view of a device (the sixth embodiment) of this invention for cooling a mold framing (a sectional view of a chamber part).
Figure 20:
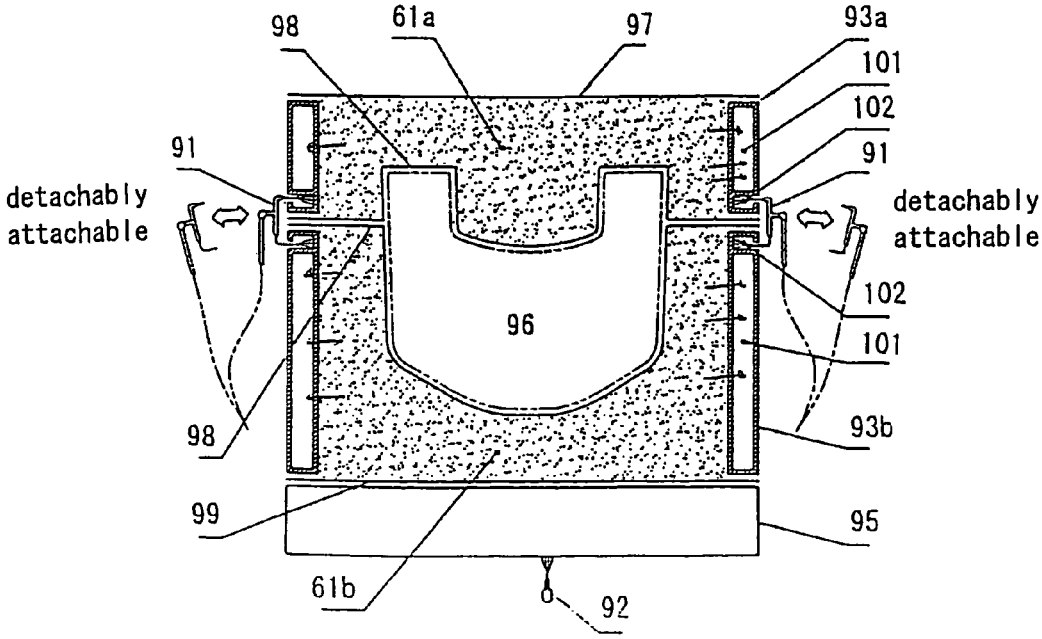
FIG. 20 is a sectional front view of FIG. 19.

A cooling system shown in FIGS. 19 and 20 for cooling a mold framing can be used for this invention. The system sprays compressed air to the bottom and side surfaces of the mold framing in order to suppress the rise of temperature of the mold framing and to prevent the film from being welded to it. By using this cooling system, compressed air is supplied into a chamber of the mold framing, which has one side, or surface, at which the metal mold framing and the film contact, to cool the mold framing to suppress the rise of it temperature and to prevent the film from being welded to it. Further, the compressed air may be sprayed to the bottom of a surface plate to cool it to prevent the film from being welded to it.

Figure 21:
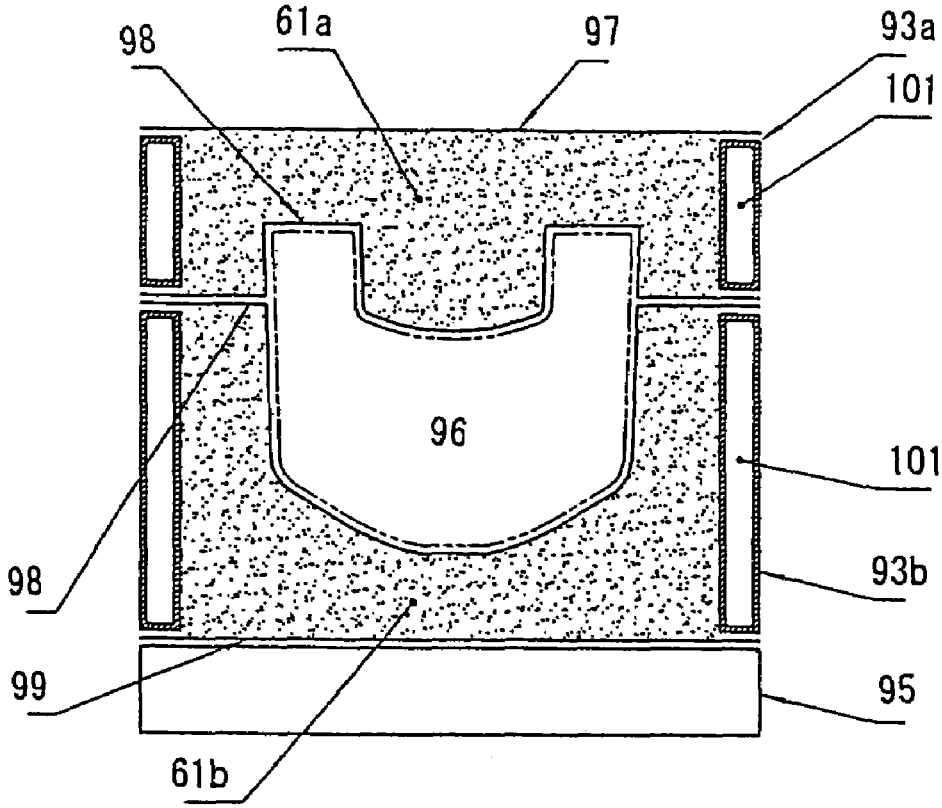
FIG. 21 a sectional front view of a conventional mold framing structure.

In the conventional metal mold framing as in FIG. 21, the side walls of both cope and drag are in the form of chambers 101, 101 (i.e., hollow). Since these chambers are evacuated by a vacuum pump (not shown), this negative pressure in the chambers shapes a cope 61*a* and a drag 61*b*. That is, the cope 61*a* and the drag 61*b* are covered by an upper flask 93*a*, a lower flask 93*b*, an upper film 97, mold surface films 98, 98, and a bottom film 99 and sucked by the vacuum, so that the shapes of the cope and the drag are kept.

During the pouring, the parts of the films that contact with the as-cast product are burned out, though the parts of the films between the upper and lower flasks remain and are then removed during the demolding. The upper and lower films remain and are removed before the demolding.

After the pouring and when the as-cast product 96 hardens to some degree, the suction is stopped, and the as-cast product is naturally cooled in the mold. If the as-cast product is one that has a great heat capacity, the heat are transferred from the product 96 to the upper and lower flasks 93*a*, 93*b* and the surface plate 95 through the cope 61*a* and the drag 61*b*, and the parts of the product surface films that are located between the upper and lower flasks 93*a*, 93*b* and the lower film are undesirably welded to the flask and the surface plate (FIG. 21).

To overcome this undesirable problem, the cooling device of the present invention includes air nozzles 91, 91 for the metal side walls and an air nozzle 92 for spraying compressed air to the metal mod framing to cool it.

For a side air blow, annular cooling chambers 102, 102 are formed in the side walls at the matching plane (the plane at which the upper and lower flask mate). The air nozzles 91, 91, which are detachably attached to, or inserted in, the annular chambers. The annular cooling chambers 102, 102 has some apertures, which may be used as insertion holes for the nozzles 91, 91 and/or gateways for the compressed air (FIG. 19). The side air blow is activated and deactivated by manually operating a valve 104 (FIGS. 19 and 20).

For a bottom air blow, the air nozzle 92 for the surface plate is located below it at the central part. The air nozzle is activated or deactivated by manually operating the valve 104.

STEPS

The metal mold framing is continuously sucked for a certain period of time after the pouring (to keep the shape of the sand mold). The suction is then stopped, and the as-cast product is naturally cooled in the metal mold framing. During this cooling, compressed air is sprayed to the metal mold framing to aggressively cool it.

Although the cooling system of this embodiment is configured as a semi-automated equipment, it may be fully automated by using actuators such as air cylinders to automatically attach and detach the nozzle, and electromagnetic valves to automatically carry out the air blow.

Although some preferable embodiments of this invention are described, these embodiments are only for explanation purpose to facilitate the understanding of the invention, and the invention is not limited to these embodiments. Therefore, it is clear to one skilled in the art that the embodiments may be changed and modified within the spirit and scope of the invention, and that the present invention includes such changes and modifications and is defined by the attached claims and the equivalents.

The invention claimed is:

1. A pouring method in a vacuum sealed process comprising the steps of:

sealingly covering the surface of a pattern plate by a shielding member;

placing a mold framing on the shielding member and then putting a fill that does not include any binder in the mold framing;

sealingly covering an upper surface of the fill and then evacuating an inside of the mold framing to suck the shielding member to the fill to shape the shielding member;

removing the pattern plate from the shielding member, thereby forming an upper mold half that has a molding surface;

forming a plurality of apertures in a part of the shielding member that contacts with the molding surface of the upper mold half;

forming a lower mold half in a similar way and mating the mold halves to define a molding cavity;

pouring molten metal in the molding cavity;

and releasing a negative pressure in the mold framing to take out an as-cast product, wherein the method further comprises the steps of:

measuring a degree of pressure reduction for at least one of the upper and lower mold halves during a period between the start and end of the pouring of the molten metal in the molding cavity; and decompressing one mold half and the the molding cavity so that Pm=1-75 KPa, Pc=4.95 KPa, and Pc−Pm=3-94 Kpa, where Pm and Pc are a pressure within the one mold half and a pressure in the molding cavity, respectively.

2. The pouring method of claim 1, including a step of disposing vent plugs in the apertures formed in the shielding member, wherein the step of decompressing the molding cavity is performed through the vent plugs, the fill, and a plurality of apertures formed in an inner side of the mold framing, the inner side contacting the fill.

* * * * *